United States Patent [19]

Carter

[11] 4,112,805

[45] Sep. 12, 1978

[54] CHORD LOCATER FOR STRINGED MUSICAL INSTRUMENTS

[76] Inventor: Ian T. Carter, 3624 156th St., Surrey, B.C., Canada, V3S/4N7

[21] Appl. No.: 800,279

[22] Filed: May 25, 1977

[51] Int. Cl.[2] ..... G10D 3/04

[52] U.S. Cl. ..... 84/317

[58] Field of Search ..... 84/316, 317

[56] References Cited

U.S. PATENT DOCUMENTS

| | | | |
|---|---|---|---|
| 2,746,337 | 5/1956 | Smit | 84/317 |
| 3,011,380 | 12/1961 | Brimhall | 84/317 |

FOREIGN PATENT DOCUMENTS

| | | | |
|---|---|---|---|
| 85,951 | 8/1957 | Netherlands | 84/317 |

*Primary Examiner*—Lawrence R. Franklin

[57] ABSTRACT

A device mounted on the neck of a stringed musical instrument such as a guitar, to facilitate the playing of chords on the musical instrument. The device includes a housing reciprocably mounted on the neck of the musical instrument above the strings thereof. Rotatably mounted in the housing are a plurality of drums having fixed stops provided in spaced predetermined locations about the circumference of each drum. When the housing is depressed towards the neck, the stops will stop the strings in predetermined locations so that strumming of the strings will produce an appropriate chordal note. A pinion is connected to one end of each of the drums which is placed in meshing engagement with a rack slidable through the housing by the fingers of the hand of the player to rotate the drums and reposition different combinations of stops relative to the strings of the instrument for changing the chordal note produced by the instrument.

6 Claims, 2 Drawing Figures

CHORD LOCATER FOR STRINGED MUSICAL INSTRUMENTS

PRIOR ART

The following patents are considered pertinent: U.S. Pat. No. 2,790,344, U.S. Pat. No. 3,091,150, U.S. Pat. No. 3,178,722, U.S. Pat. No. 3,446,108, U.S. Pat. No. 3,854,370.

BACKGROUND OF THE INVENTION

This invention relates to a chord locating attachment for a fretted musical instrument such as a guitar, banjo, ukelele, mandolin and the like.

The present invention is directed to an attachment to the neck of a fretted musical instrument to facilitate the playing of chords on the instrument by beginners. The playing of stringed instruments, such as a guitar, requires that one hand be used to stop off a plurality of strings at various frets, the remaining hand being engaged in the plucking of individual strings to produce single notes, or executing a strumming action across the strings to produce chords. A beginner in playing such an instrument must master manual dexterity in being able to simultaneously stop off a number of strings to produce the required chordal notes. This has discouraged a large number of people from continuing to learn to play the instrument, since the mastering of the placing of fingers on the strings to produce the various chords is a difficult technique. The chord locator of the present invention facilitates the playing of chords on a stringed instrument and enables even a beginner to enjoy the playing of the instrument.

SUMMARY OF THE INVENTION

In accordance with the invention, the chord locator includes a clamp mounted on the neck of a stringed musical instrument such as a guitar. A housing is reciprocably mounted on the clamp and contains a number of rotatable drums having a plurality of stops fixed thereto in spaced relation about the circumference thereof so that when depressed in combination with one hand, the stops will contact the strings on the neck of the instrument so that by strumming the strings with the other hand an appropriate chord can be played on the instrument. Fixed to each drum is a pinion in meshing engagement with a rack slidable through the housing. The rack is connected to a finger rest extending upwardly through the housing so that the fingers of one hand can be used to rotate the drums to an appropriate chord position corresponding to an index mark for that chord on the housing adjacent the finger rest. The finger rest and rack are slid laterally relative to the housing to rotate the drums to position the stops above the strings and then by simply depressing the finger rest and the housing while strumming the strings with the other hand, an appropriate chord is played, even by a beginner.

BRIEF DESCRIPTION OF THE DRAWING

Further objects and advantages of the invention will become apparent from the following description and claims, and from the accompanying drawings, wherein:

DETAILED DESCRIPTION OF THE PREFERRED EMBODIMENT

Figure 1:
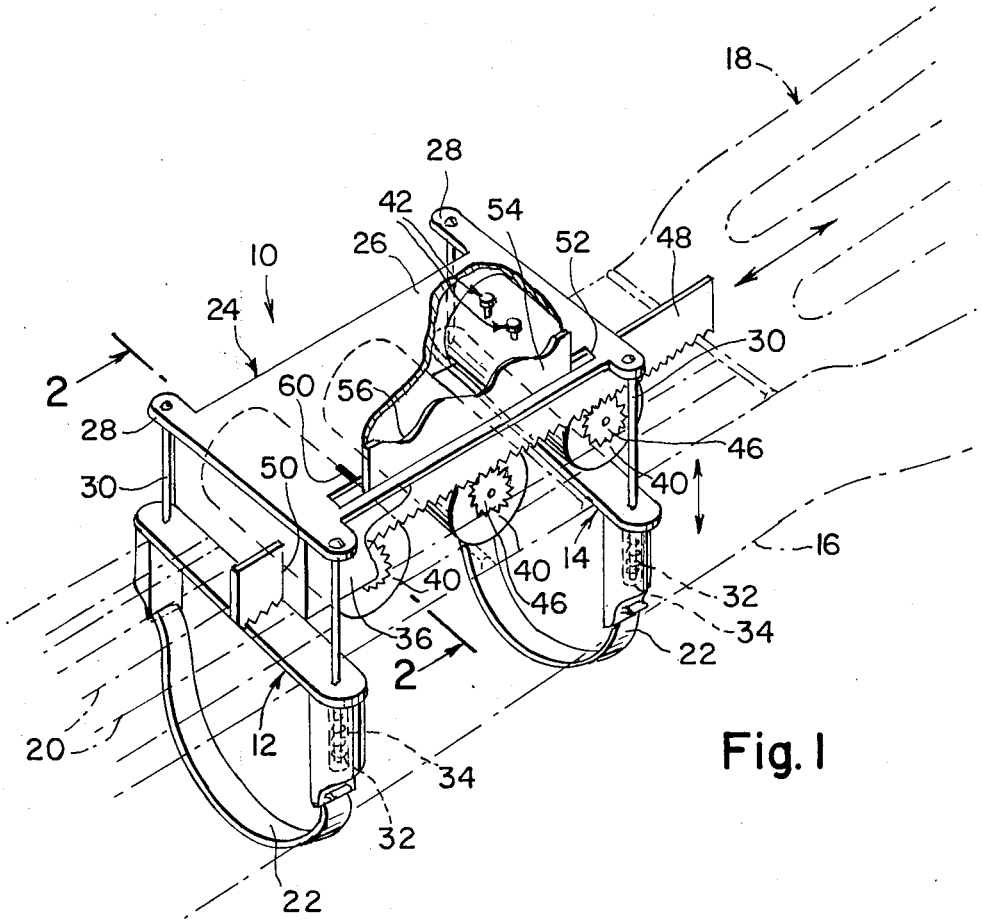
FIG. 1 is a perspective view of the chord locator of the present invention.

Referring now to the drawing in detail, wherein like numerals indicate like elements throughout the several views, the chord locator 10 of the present invention includes a pair of U-shaped clamps 12 and 14 encircling the neck 16 of a guitar 18 or other fretted musical instrument above the strings 20 strung on the neck 16. Elastic straps 22 are connected to opposite legs of each clamp 12 and 14 for securing each of the clamps 12 and 14 to the neck 16 of guitar 18. The clamps 12 and 14 are located relative to strings 20 on neck 16 in a predefined fretted area so as to be able to locate and play chords on guitar 18 as will be explained further hereinafter.

Figure 2:
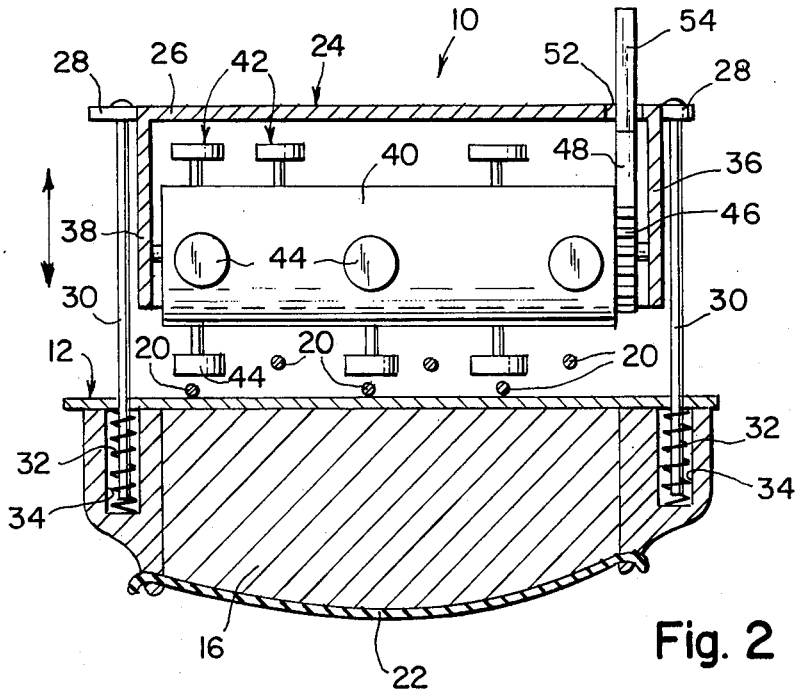
FIG. 2 is a cross-sectional view taken substantially along the plane indicated by line 2—2 of FIG. 1.

Reciprocably mounted on the bight porion of each clamp 12 and 14 is a housing 24 having a top plate 26 containing lateral extensions 28 mounting substantially vertical pins 30. Each pin 30 is inserted through the bight portion of one of the clamps 12 and 14 into the interior of the legs of the clamp as illustrated in FIGS. 1 and 2. A coil spring 32 encircles the bottom of each pin 30 and is connected at one end to each pin within the interior of the legs of each of the clamps 12 and 14. By depressing top plate 26, pins 30 can move downwardly within the slots 34 in each clamp leg expanding the spring 32. Release of top plate 26 enables spring 32 to raise top plate 26 in housing 24 to its initial position.

Rotatably mounted between a pair of side walls 36 and 38 of housing 24 are a plurality of drums 40. Each drum has a plurality of stops 42 fixed about its circumference in spaced relation. Stops 42 have a circular head 44 which can be used to contact selected strings 20 to stop the strings in combination to produce a chordal note when the strings 20 are strummed.

Fixed to one end of each drum 40 is a pinion 46. Each of the pinions 46 is in meshing engagement with a rack 48 slidable through aligned slots 50 in opposite portions of housing 24. Connected to the top of rack 48 and extending through a slot 52 in the top plate 26 of housing 24 is a finger rest 54 having a plurality of valleys 56 for receiving the fingers of one of the hands of the instrument player disposed about the neck of guitar 18. The fingers can be positioned within the valleys 56 on finger rest 54, extend over the finger rest 54, and be comfortably supported on top plate 26 of housing 24.

In order to play a chord using the chord locator 10, it is only necessary to move finger rest 54 laterally relative to housing 24 in slot 52 until a mark on the finger rest is aligned with an index mark 60 on top plate 26, which index mark 60 corresponds to a particular chord to be played on guitar 18. By moving finger rest 54 laterally, rack 48 will rotate pinions 46 to rotate each of the drums 40 to position the proper combination of stops 42 relative to the strings 20 of guitar 18 to produce an appropriate chordal note. It is only necessary to depress top plate 26 against springs 32 to move the heads 44 of the stops in line with the strings 20 into contact with the strings to stop the strings while strumming the strings with the other hand to produce the appropriate chordal note.

While a specific embodiment of a chord locator for stringed musical instruments has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A chord locator for a stringed musical instrument comprising:

clamp means adapted to be mounted on the stringed musical instrument, a housing reciprocably mounted on said clamp means, a plurality of drums rotatably mounted in said housing above the strings of the musical instrument, means on said housing for selectively rotating said drums in unison, and a plurality of stops fixed in predetermined spaced relation to the circumference of each of said drums above the strings of said musical instrument, whereby upon movement of said housing towards the strings of said musical instrument said stops will stop said string in proper position to produce a predetermined chordal note.

2. The chord locator of claim 1 wherein said means for rotating said drums includes a pinion fixed to each drum in meshing engagement with a rack slidably supported through said housing.

3. The chord locator of claim 2 wherein said housing includes a elongated slot, and a finger rest extending through said slot connected to said rack for sliding said rack to a predetermined location to rotate said drums to position a predetermined combination of stops on said drums above the strings of the instrument at predetermined locations.

4. The chord locator of claim 3 wherein said housing includes a plurality of index marks adjacent said finger rest corresponding to chordal notes determined by stopping said strings of the instrument at predetermined locations.

5. The chord locator of claim 1 wherein said clamp means includes a pair of spaced, substantially U-shaped clamps adapted to encircle a neck of said musical instrument, and said housing includes a plurality of pins extending downwardly therefrom received within openings in the legs of each of said clamps, and spring means in said openings connected to said pins for urging said pins away from said clamps.

6. The chord locator of claim 5 wherein the legs of each of said clamps are connected by an elastic strap for mounting said clamps on the neck of the musical instrument.

* * * * *